US005761771A

United States Patent [19]

Leifeld

[11] Patent Number: 5,761,771

[45] Date of Patent: Jun. 9, 1998

[54] APPARATUS FOR DETECTING AND SEPARATING FOREIGN BODIES FROM A FIBER TUFT FLOW

[75] Inventor: Ferdinand Leifeld, Kempen, Germany

[73] Assignee: Trützschler GmbH & Co. KG, Mönchengladbach, Germany

[21] Appl. No.: 642,638

[22] Filed: May 3, 1996

[30] Foreign Application Priority Data

May 5, 1995 [DE] Germany ..... 195 16 568.3

[51] Int. Cl.[6] ..... D01B 3/00

[52] U.S. Cl. ..... 19/200; 19/105; 356/335

[58] Field of Search ..... 19/66 R, 200, 19/204, 205, 98, 105, 107, 145.5; 356/237, 238, 335; 250/559.04, 559.4, 559.41

[56] References Cited

U.S. PATENT DOCUMENTS

| | | | |
|---|---|---|---|
| 4,805,266 | 2/1989 | Leifeld et al. | 19/105 |
| 4,858,277 | 8/1989 | Pinto et al. | 19/200 |
| 4,977,645 | 12/1990 | Hosel | 19/200 |
| 5,125,514 | 6/1992 | Oehler et al. | 209/590 |
| 5,130,559 | 7/1992 | Leifeld et al. | 19/98 |
| 5,173,995 | 12/1992 | Pezzoli et al. | 19/105 |
| 5,205,019 | 4/1993 | Schlichter et al. | 19/200 |
| 5,586,365 | 12/1996 | Leifeld et al. | 19/105 |

FOREIGN PATENT DOCUMENTS

| | | |
|---|---|---|
| 414961 | 3/1991 | European Pat. Off. . |
| 396546 | 6/1995 | European Pat. Off. . |
| 31 33 744 | 8/1982 | Germany . |
| 37 34 145 | 4/1989 | Germany . |
| 284 911 | 11/1990 | Germany . |
| 90 17 759 | 2/1992 | Germany . |
| 41 29 882 | 3/1992 | Germany . |
| 2260145 | 4/1993 | United Kingdom . |

*Primary Examiner*—Michael A. Neas
*Attorney, Agent, or Firm*—Spencer & Frank

[57] ABSTRACT

An apparatus for detecting a foreign substance in a fiber tuft stream and for separating the foreign substance therefrom. The apparatus includes a conduit guiding the fiber tuft stream therethrough in a conveying direction; an optical sensor system situated at a first location of the conduit for detecting a foreign substance in flight and for emitting signals representing the foreign substance; a separating device situated at a second location of the conduit downstream of the first location as viewed in the conveying direction; an evaluating device for processing the signals; a control device connected to the optical sensor system, the separating device and the evaluating device for operating the separating device; and an opening device situated in the conduit upstream of the optical sensor system as viewed in the conveying direction for opening the fiber tufts prior to passage thereof past the optical sensor system.

17 Claims, 3 Drawing Sheets

APPARATUS FOR DETECTING AND SEPARATING FOREIGN BODIES FROM A FIBER TUFT FLOW

CROSS REFERENCE TO RELATED APPLICATION

This application claims the priority of German Application No. 195 16 568.3 filed May 5, 1995.

BACKGROUND OF THE INVENTION

This invention relates to an apparatus which finds application in a fiber preparation (cleaning) line for recognizing and separating foreign substances such as pieces of fabric, straps, strings, pieces of foil present in a fiber tuft mass removed from fiber bales by a bale opener. The apparatus is of the type which includes an optical sensor system for recognizing the foreign substance, followed by a separating device for removing such substance. The optical sensor system is connected with the separating device by means of an evaluating device and a control device.

A known apparatus of the above-outlined type may be installed in a fiber processing (cleaning and blending) line downstream of a coarse cleaning machine or a mixer, that is, prior to introducing the fiber tufts into an apparatus which performs fine cleaning. The fiber tufts are admitted by a suction condenser into a supply duct, one wall of which is formed by an endless, obliquely oriented conveyor belt. Thereafter, the fiber tufts are carried by the conveyor past an optical recognizing system (such as an optical color sensor system). An evaluating device evaluates the measurements and, upon appearance of foreign substances, actuates a corresponding group of nozzles of a nozzle bank. The nozzles of a nozzle group of the nozzle bank are actuated as soon as the upstream-arranged optical sensor has recognized the foreign substances. The fiber tufts blown out of the system and containing foreign substances are introduced into a waste container. The remaining, uncontaminated good fibers are introduced into a collecting chute and then reach the consecutive cleaning machine.

It is a disadvantage of the above-outlined conventional arrangement that the fiber tufts are relatively large and are of closed structure and, as a result, foreign substances may be embedded in the fiber material. Due to this phenomenon the degree of efficiency in recognizing and eliminating foreign bodies is reduced. It is a further disadvantage that during the separation of a foreign substance, an excessive amount of good fibers is also removed. Furthermore, the conventional apparatus is complex and requires substantial technical outlay.

SUMMARY OF THE INVENTION

It is an object of the invention to provide an improved apparatus of the above-outlined type from which the discussed disadvantages are eliminated and which, in particular, makes possible a simple and improved recognition and separation of foreign substances.

This object and others to become apparent as the specification progresses, are accomplished by the invention, according to which, briefly stated, the apparatus for detecting a foreign substance in a fiber tuft stream and for separating the foreign substance therefrom includes a conduit guiding the fiber tuft stream therethrough in a conveying direction; an optical sensor system situated at a first location of the conduit for detecting a foreign substance in flight and for emitting signals representing the foreign substance; a separating device situated at a second location of the conduit downstream of the first location as viewed in the conveying direction; an evaluating device for processing the signals; a control device connected to the optical sensor system, the separating device and the evaluating device for operating the separating device; and an opening device situated in the conduit upstream of the optical sensor system as viewed in the conveying direction for opening the fiber tufts prior to passage thereof past the optical sensor system.

By pulling apart the fiber tufts prior to their detection and separation, the fiber material is opened to a more significant extent and, as a result, the foreign substances are freed, that is, they are no longer embedded in the fiber material. Entirely free foreign substances may be separated from the fiber stream even without removing fiber material therewith. In this manner, the recognition of foreign substances and their separation from the fiber stream is significantly improved. Further, a lesser quantity of good fibers are separated whereby the degree of efficiency is significantly increased. It is a further advantage of the invention that the opened fiber tufts are optically monitored and separated in free fall. By virtue of the fact that the material is not presented to the sensor system on a separate conveyor, a significant simplification of the system is achieved.

By means of the apparatus according to the invention the following exemplary types of foreign substances may be reliably recognized and separated: plastic sheet parts, pieces of fabric made of plastic films, jute or cotton, meshed pieces, plastic, jute or cotton strings, pieces of colored polypropylene sheets or the like, oily fiber tufts and also pieces having a higher specific weight, such as pebbles, seeds and the like. As a result, operational disturbances during further processing of the fiber tufts, for example, wear of clothing, malfunctions in the machinery, thread breakages, interference with the coloring and the like are significantly reduced.

DESCRIPTION OF THE PREFERRED EMBODIMENTS

Figure 1:
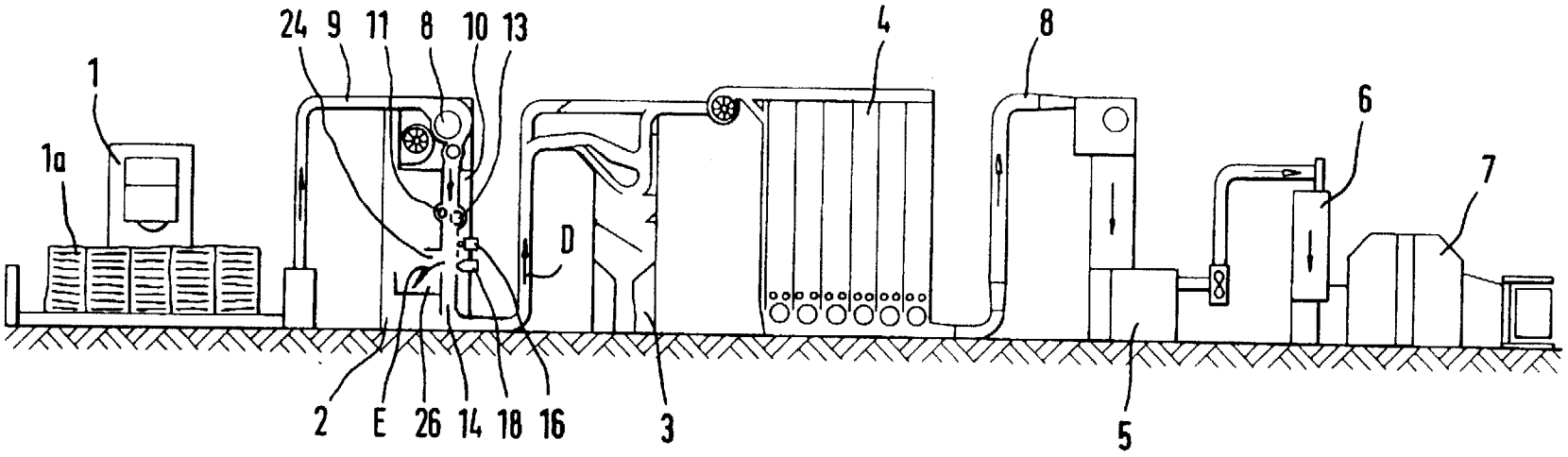
FIG. 1 is a schematic side elevational view of a fiber tuft processing line including the apparatus according to the invention.

FIG. 1 shows a fiber tuft processing (opening, cleaning and mixing) line formed of a plurality of machines connected in series by pneumatic fiber-transporting ducts, such as duct 9 in which the fiber-conveying air stream is generated by transport fans. The processing line includes a bale opener 1 and a multi-mixer 4 between which an apparatus 2 according to the invention is inserted. The inlet zone of the apparatus 2 includes a condenser 8. The apparatus 2 is followed by a heavy-particle separator 3. Downstream of the multi-mixer 4 a fine opener 5, a card feeder 6 and a carding machine 7 are arranged. The fiber tuft processing line formed of components 1–5 may supply a plurality of carding machines 7, each provided with its own card feeder 6. The fiber bales worked on by the bale opener 1 are designated at 1*a*.

Figure 2:
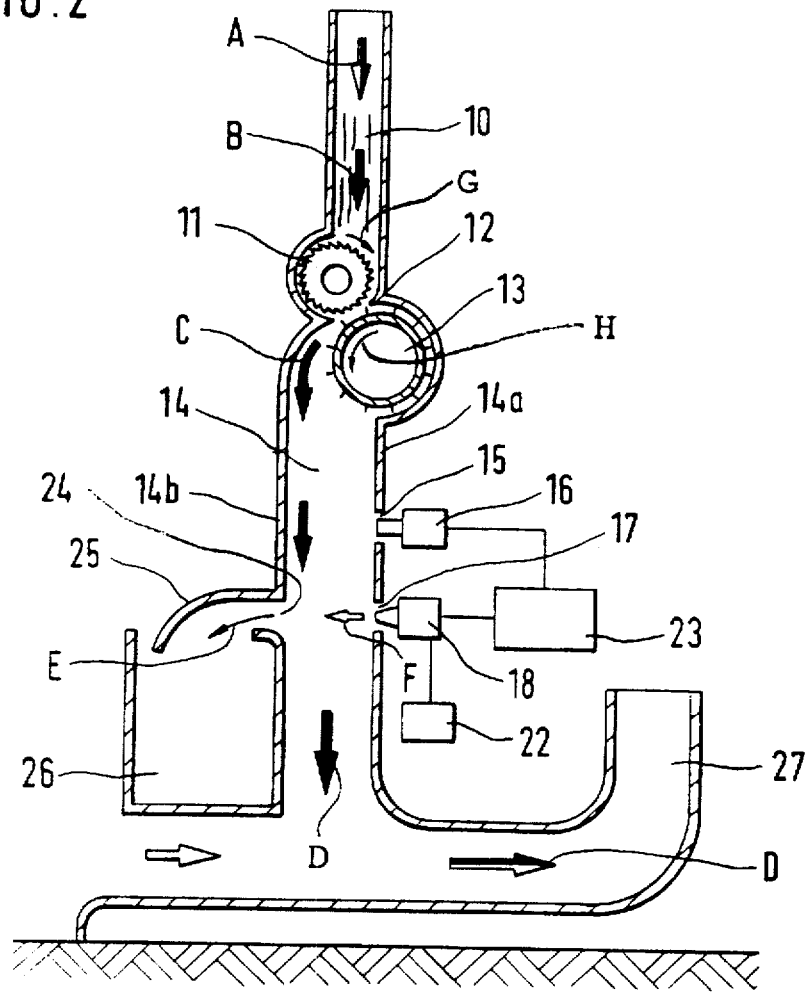
FIG. 2 is a schematic sectional side elevational view, with block diagram, of a preferred embodiment of the invention including an intake roll, an intake tray, an opening roll, a sensor system and a pneumatic separating device.
Figure 5:
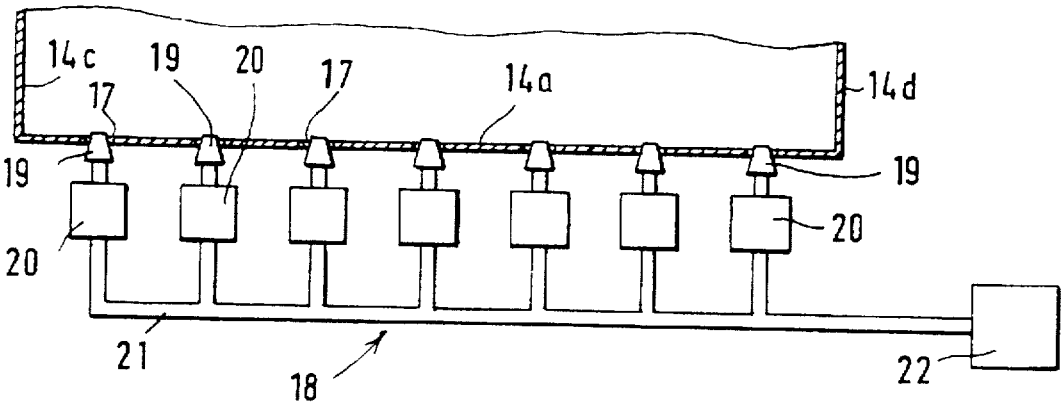
FIG. 5 is a schematic sectional top plan view of a pneumatic blowout device including a series of blow nozzles according to the invention.
Figure 6:
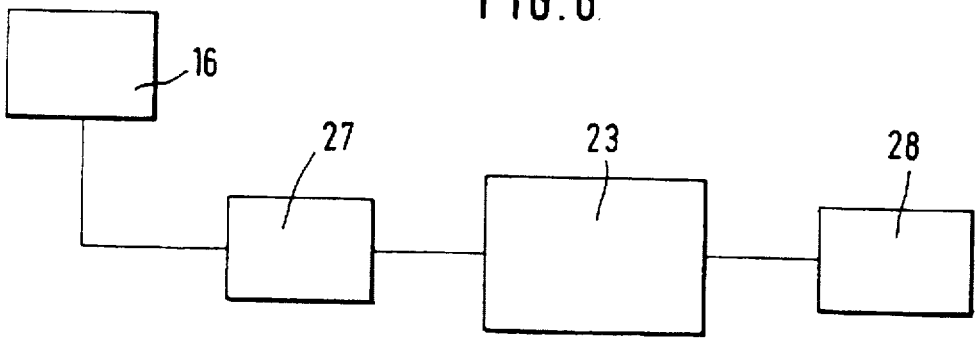
FIG. 6 is a block diagram of an electronic control device to which the sensor system, an image evaluating system and a valve control for the pneumatic nozzles are connected.

Turning to FIGS. 2 and 5, the duct 9 shown in FIG. 1 is adjoined by an upper chute 10 in which the fiber material B flows downward to a fiber opening device formed of a slowly rotated intake roll 11 cooperating with an intake tray 12 and a rapidly rotating opening roll 13. The direction of rotation of the rolls 11 and 13 is indicated by arrows G and H. The fiber tufts opened by the opening roll 13 have an individual weight of preferably about 0.1–1 g. The opening device 11, 12, 13 introduces the fiber material into a lower chute 14 which is of rectangular cross-sectional configuration and which is formed by four vertically extending walls 14*a*, 14*b*, 14*c* and 14*d*.

In the chute wall 14*a*, underneath the opening device 11, 12, 13, an opening 15 is provided through which an optical sensor system 16, such as a camera, monitors the fiber tufts C as they move past. In the wall 14*a*, underneath the opening 15, a series of horizontal openings 17 are provided, each being aligned with respective blow nozzles 19 which form a pneumatic removal device 18. Each nozzle 19 of the pneumatic removal device 18 is provided with a valve 20 for operating the respective nozzle. The valves 20 are coupled to a pressure source 22 by a conduit 21. The sensor system 16 and the pneumatic removal device 18 are connected to an electronic control and regulating device 23. In the vertical wall 14*b* which is disposed opposite the wall 14*a*, an aperture 24 is provided whose upper edge is adjoined by a curved guide plate 25 extending externally of the chute 14 and oriented towards a waste container 26. The foreign substances exposed to air blasts F from the nozzles 19 in a direction transversely to the fiber flow in the chute 14 exit through the aperture 24 and fall into the container 26. It is to be understood that suction nozzles may be used as an alternative to blow nozzles. The cleaned fiber tufts D are advanced pneumatically in a conveying duct 27 to the successive fiber processing machine.

Figure 3:
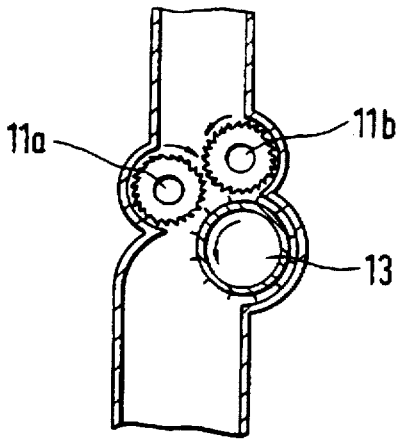
FIG. 3 is a sectional side elevational view of a modified detail of FIG. 2.

FIG. 3 illustrates an opening device which differs from that shown in FIG. 2 in that it has two slowly rotating feed rolls 11*a* and 11*b*. Essentially, the feed roll 11*b* takes over the function of the feed tray 10 shown in FIG. 2.

Figure 4:
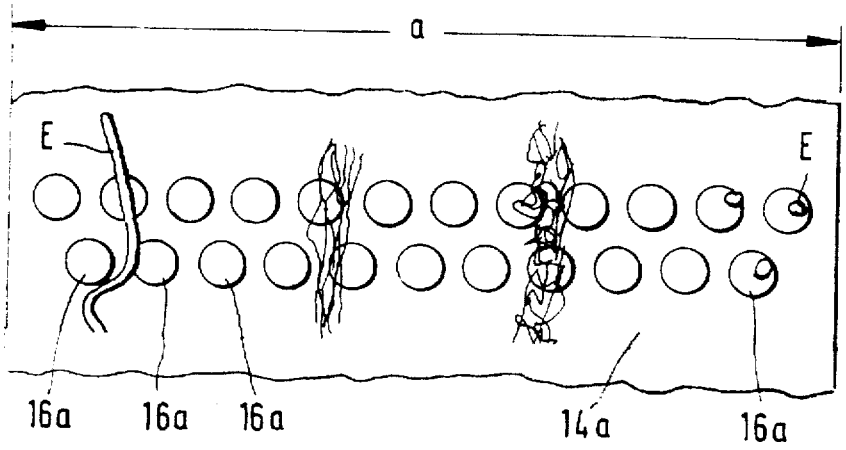
FIG. 4 is a schematic side elevational view of a sensor system including a plurality of sensors according to the invention.

According to the embodiment shown in FIG. 4, the optical sensor system 16 is formed of a plurality of sensor elements 16*a* (for example, color sensors) arranged in two parallel rows at the chute wall 14*a* along the width a of the chute 14 such that the sensor elements 16*a* of one row are staggered with respect to those forming the other row.

It will be understood that the above description of the present invention is susceptible to various modifications, changes and adaptations, and the same are intended to be comprehended within the meaning and range of equivalents of the appended claims.

What is claimed is:

1. An apparatus for detecting a foreign substance in a fiber tuft stream and for separating the foreign substance therefrom, comprising (a) a conduit guiding the fiber tuft stream therethrough in a conveying direction;

(b) optical sensor means situated at a first location of said conduit for detecting a foreign substance in flight and for emitting signals representing said foreign substance;

(c) separating means situated at a second location of said conduit downstream of said first location as viewed in the conveying direction for deviating conveyed material to waste from said conduit when said separating means is in an actuated state and for causing all conveyed material to continue advance in said conduit when said separating means is in an idle state;

(d) evaluating means for processing said signals;

(e) control means connected to said optical sensor means, said separating means and said evaluating means for placing said separating means into said actuated state in response to said signals emitted by said optical sensor means; and (f) an opening device situated in said conduit upstream of said optical sensor means as viewed in said conveying direction for opening the fiber tufts prior to passage thereof past said optical sensor means.

2. The apparatus as defined in claim 1, wherein said conduit is substantially vertically oriented for effecting a free fall of the fiber tufts by gravity.

3. The apparatus as defined in claim 2, further comprising pneumatic means for advancing fiber tufts, freed of foreign substances, from said conduit with a conveying air stream.

4. The apparatus as defined in claim 1, wherein said opening device comprises (a) a slowly rotating feed roll;

(b) a stationary feed tray cooperating with said feed roll for advancing the fiber tufts; and (c) a rapidly rotating opening roll situated downstream of said feed roll as viewed in said conveying direction for receiving the fiber tufts from said feed roll for opening and advancing the fiber tufts toward said optical sensor means.

5. The apparatus as defined in claim 1, wherein said opening device comprises (a) a slowly rotating first feed roll;

(b) a slowly rotating second feed roll cooperating with said first feed roll for advancing the fiber tufts; and (c) a rapidly rotating opening roll situated downstream of said first and second feed rolls as viewed in said conveying direction for receiving the fiber tufts from said first and second feed rolls for opening and advancing the fiber tufts toward said optical sensor means.

6. The apparatus as defined in claim 1, wherein said opening device is situated immediately upstream of said optical sensor means.

7. The apparatus as defined in claim 1, wherein said opening device comprises a rapidly rotating opening roll.

8. The apparatus as defined in claim 1, wherein said conduit includes, downstream of said opening device, first and second walls facing one another.

9. The apparatus as defined in claim 8, wherein said optical sensor means comprises an optical sensor device supported at said first wall.

10. The apparatus as defined in claim 9, wherein said optical sensor device comprises a camera.

11. The apparatus as defined in claim 9, wherein said first wall comprises a light-transmitting region aligned with said optical sensor device.

12. The apparatus as defined in claim 9, wherein said conduit has an inner width measured perpendicularly to said conveying direction and further wherein said optical sensor device comprises a plurality of sensor elements forming a sensor element group extending substantially along said entire width of said conduit.

13. The apparatus as defined in claim 1, wherein said separating means includes an air-current generating device for pneumatically removing foreign substances from the fiber tuft stream.

14. The apparatus as defined in claim 13, wherein said conduit has an inner width measured perpendicularly to said conveying direction and further wherein said air-current generating device comprises a plurality of blow nozzles arranged in a group extending substantially along said entire width of said conduit.

15. The apparatus as defined in claim 13, further comprising valve means for operating said air-current generating device, valve control means for controlling said valve means and an electronic control and regulating device; said optical sensor means, said evaluating means and said valve control means being connected to said electronic control and regulating device.

16. The apparatus as defined in claim 13, further comprising an aperture provided in one of said first and second walls in alignment with said air-current generating device to effect removal of the foreign substances from said conduit by the air current generated by said air-current generating device.

17. The apparatus as defined in claim 16, wherein said optical sensor means comprises an optical sensor device supported at said first wall; said aperture being provided in said second wall.

* * * * *